US005189864A

United States Patent [19]

Cinotti et al.

[11] Patent Number: 5,189,864

[45] Date of Patent: Mar. 2, 1993

[54] METHOD OF WRAPPING REAMS OF PAPER, AND EQUIPMENT FOR THE IMPLEMENTATION OF SUCH A METHOD

[75] Inventors: Andrea Cinotti, Bologna; Gilberto Forni, San Giovanni in Persiceto; Davide Dall'omo, Bologna, all of Italy

[73] Assignee: Wrapmatic S.p.A., Bologna, Italy

[21] Appl. No.: 880,884

[22] Filed: May 8, 1992

[30] Foreign Application Priority Data

May 24, 1991 [IT] Italy ..... 000177 A/91

[51] Int. Cl.[5] ..... B65B 11/10; B65B 13/20

[52] U.S. Cl. ..... 53/439; 53/228; 53/466; 53/528

[58] Field of Search ..... 53/439, 436, 466, 465, 53/399, 231, 228, 220, 210, 528, 529, 586, 582

[56] References Cited

U.S. PATENT DOCUMENTS

| | | | |
|---|---|---|---|
| 2,700,459 | 1/1955 | Anspacher | 53/528 X |
| 2,718,738 | 9/1955 | Mast et al. | 53/228 X |
| 3,306,003 | 2/1967 | Sundy et al. | 53/228 |
| 3,307,326 | 3/1967 | Krebs | 53/228 X |
| 4,738,078 | 4/1988 | Bene et al. | 53/439 |
| 4,989,397 | 2/1991 | Tomac et al. | 53/528 |

*Primary Examiner*—James F. Coan

*Attorney, Agent, or Firm*—Laff, Whitesel, Conte & Saret

[57] ABSTRACT

Reams of paper advancing in a horizontal direction on a first belt are straightened initially by interaction with a transverse vertical barrier, while wrapping paper is drawn out from below the first belt and directed onto a third belt; the paper is pulled upright into the path of the ream by the elevation of a first gate affording a gap of height at least equal to that of the ream whereupon the ream is directed through the gap, becoming partially enveloped by the paper, then stopped on the third belt while the wrapping paper is cut near to the gate and the trailing edge simultaneously moistened with gum. Finally a second gate identical to the first is raised at the entry to the third belt, drawing up the remaining portion of the paper, and the conveying direction is reversed to take the ream back through the relative gap; the ream is thus enveloped completely and the gummed edge of the wrapping paper flattened and secured.

7 Claims, 3 Drawing Sheets

METHOD OF WRAPPING REAMS OF PAPER, AND EQUIPMENT FOR THE IMPLEMENTATION OF SUCH A METHOD

BACKGROUND OF THE INVENTION

The invention relates to a method of wrapping reams of paper and to equipment for the implementation of such a method, suitable in particular for large size reams.

Conventionally, large size reams (typically ISO A0) are wrapped using a machine consisting essentially in a moving surface along which the reams advance, and above the surface, a succession of stations by which each ream is wrapped; the first such station serves to draw out a given length of wrapping paper into a position such that it will be impinged on by the leading face of the advancing ream, whereupon the continued advance of the ream along the moving surface causes the wrapping paper to be flattened against the top and bottom sheets of the stack.

At the next station, the wrapping paper is cut to size and, at the same time, adhesive is sprayed by an adjacent station onto the cut edge of the paper already part-enveloping the stack, in such a way as to permit of fastening the wrapping into a sheath around the larger faces of the ream. The subsequent fastening operation, in which the gummed edge and the opposite edge of the wrapping are flattened and overlapped, is performed by an additional moving unit designed to follow the ream forward, with all the attendant drawbacks such a solution suggests, most notably the difficulty in making the wrapping paper tight and the degree of precision obtainable in overlapping the edges.

Thereafter, the smaller end flaps of the wrapping are flattened and secured at a further station of the machine by means of conventional fixed folding elements.

This particular method of wrapping large size reams betrays certain drawbacks: the manner in which the wrapping paper is folded around the ream tends to be imprecise, as aforementioned, or at least the paper is not properly tightened over the advancing stack of sheets; moreover, the gum is applied to a part of the wrapping paper already flattened over the ream and with the ream itself in movement, an operation liable not only to occasion positioning error but also to leave the topmost sheet of the ream fouled and subsequently unfit for use as a result.

Given the size of the reams and the succession of work stations incorporated, a machine capable of implementing the above method must be of notable proportions both in length and height, a factor tending also to increase its costs of construction and transportation.

Accordingly, the object of the present invention is to overcome the aforementioned drawbacks by setting forth a swift, accurate and practical method of wrapping reams, and relative equipment suitable for its implementation, such as will also guarantee a secure and faultless application of gum to the edge of the wrapping paper.

SUMMARY OF THE INVENTION

The stated object is realized in a wrapping method according to the present invention, whereby reams of paper are taken through a succession of steps that consist in aligning and compacting the sheets of the ream with the aid of a transverse vertical barrier, drawing out wrapping paper from a position below the ream, and raising and interposing a first gate, which affords an opening of height at least equal to the height of the ream, in such a way that the wrapping paper is drawn upright in the manner of a wall occupying the path of the advancing ream and a further advance through the gate causes a part of the ream including the leading face to be enveloped in a first portion of the wrapping paper. Thereafter, with the ream brought to a standstill, the wrapping paper is cut at a point adjacent to the first gate and gum simultaneously applied to the edge left by the cut, a second gate identical to the first is raised in such a way as to draw up the remaining portion of the wrapping paper not yet enveloping the ream, and the direction of movement followed during the previous wrapping step is then reversed such that the ream is conveyed backward through the second gate, becoming fully enveloped in the wrapping paper, and the cut edges of the paper are overlapped and secured by the gum.

BRIEF DESCRIPTION OF THE DRAWINGS

The invention will now be described in detail, by way of example, with the aid of the accompanying drawings in which.

DESCRIPTION OF THE PREFERRED EMBODIMENTS

Figure 1:
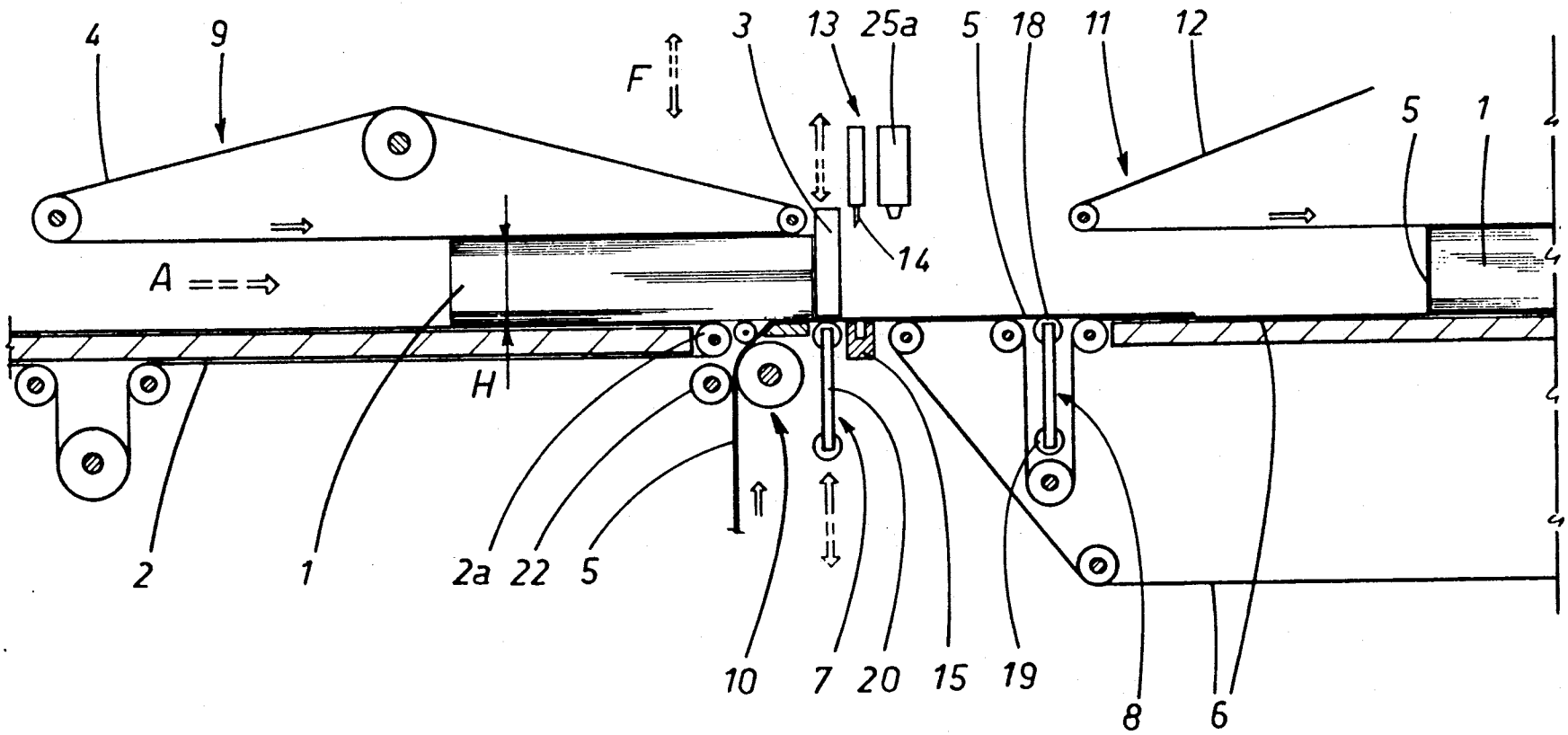
FIG. 1 is a schematic representation of equipment for wrapping large size reams of paper, viewed in side elevation and in a configuration corresponding to a first step of the method according to the invention.

Referring to the drawings, equipment according to the present invention for wrapping large size reams of paper essentially comprises: a first conveying station 9 through which reams 1 are directed singly and in succession, a feed station 10 supplying wrapping paper 5, a first wrapping gate 7, means 13 by which to cut the wrapping paper 5, a second conveying station 11, and a second wrapping gate 8 by which the paper 5 is fastened securely around the ream 1.

More exactly, it will be seen from the drawings that the first conveying station 9, through which the ream 1 passes horizontally, consists in a first belt 2 looped around at least one driving roller **2*a* and activated in such a way as to advance the ream in the direction denoted by the arrow A in FIG. 1. 3 denotes a vertical barrier positioned just beyond the forwardmost end of the first belt 2, which is capable of descending and ascending in such a way as to permit of compacting an advancing ream 1, and allowing the ream to advance further following such compaction. The first conveying station 9 further comprises a second belt 4, looped around respective rollers and disposed facing the first belt 2 from above, of which the conveying branch runs parallel with and at the same surface speed as that of the first belt 2; the second belt 4 is also capable of movement in a vertical direction (see arrow F) in such a way as to bring about the aforementioned compaction of the ream 1 during its advance, or more exactly at the moment when its leading face encounters the vertical barrier 3**.

The feed station 10, which is designed to supply a predetermined length of wrapping paper 5 at each cycle, occupies a position adjacent to the vertical barrier 3 and below the first conveying station 9, from where the paper 5 is extended in the direction of the arrow A; in practice, the feed station 10 consists in a pair of rollers 23 rotatable about horizontal axes, positioned at the forwardmost end of the first belt 2 and connected (intermittently, by means of a conventional type clutch coupling not shown in the drawings) to the driving roller 2*a* in such a way that the wrapping paper 5, stored below the station 10, can be paid out at a rate of feed identical to the velocity at which the ream 1 is directed over a horizontal platform 24 positioned between the driving roller 2*a* and the barrier 3. The first gate 7 is positioned directly beneath the barrier 3 and consists in two constraint elements, embodied in the example of the drawings as a pair of freely revolving rollers 16 and 17, horizontally disposed and mutually parallel, which are united adjustably one with another by a pair of vertical rods 20 and function intermittently as a means of interception, affording a passage of height equal to the height H of the ream 1. The first gate 7 is also capable of movement in the vertical direction, synchronously with the movement of the barrier 3, in such a way that its ascent causes a portion of the extended wrapping paper 5 to be drawn upright, occupying the path of the advancing ream 1 in the manner of a wall or curtain.

The aforementioned cutting means 13 are situated immediately beyond the first gate 7 (considered in the direction followed by the advancing ream), and capable of movement in a direction substantially transverse to the conveying direction A to the end of effecting the cut; such means 13 consist in an ascending and descending vertical blade 14 and a corresponding striking plate 15 positioned beneath the extended length of paper 5, and are timed to operate following the passage of the ream 1 through the first gate 7, thus leaving an exposed edge 5*a* of the wrapping sheet 5 trailing behind the ream. The equipment also comprises applicator means 25 positioned parallel to and operated simultaneously with the cutting means 13, of which the purpose is to apply gum to the trailing edge 5*a* of the sheet of wrapping paper 5 severed by the blade 14; in the example of the drawings, such means 25 are shown as conventional spray nozzles 25*a*.

The second conveying station 11 consists in a third belt 6 occupying the same plane as the first belt 2 and a fourth belt 12, disposed parallel with and facing the third belt 6, which during the initial wrapping step is driven in the direction opposite (see arrow F1) to that of the general conveying direction A; the third and fourth belts thus afford a passage serving to admit the ream 1 and to favor the enveloping action of the first portion of the wrapping paper 5 elevated by the first gate 7 and carried forward by the advance of the ream.

The second wrapping gate 8 is positioned at the entry point of the second conveying station 11 and embodied in identical fashion to the first gate 7, that is to say, consisting in a pair of horizontal rollers 18 and 19 united adjustably by a pair of vertical rods 21; the gate 8 is similarly capable of movement in the vertical direction, to the end of drawing up the portion of the wrapping paper 5 still trailing and causing it to envelop the ream 1 during a subsequent step in which the conveying direction A is reversed.

There now follows a description of the steps by which reams 1 are wrapped using equipment embodied according to the invention.

A ream 1 advancing in the direction of the arrow A is squared up and compacted when engaged frontally by the barrier 3, which during this step occupies the lowered position, and compressed as the result of the second belt 4 descending and thus drawing closer to the first belt 2 (see FIG. 1).

During this same step, a predetermined length of wrapping paper 5 is drawn upwards from below the first belt 2 by the rollers of the feed station 10 and directed beyond the vertical barrier 3 onto the third belt 6, likewise in the general conveying direction A (see also FIG. 1).

Figure 2:
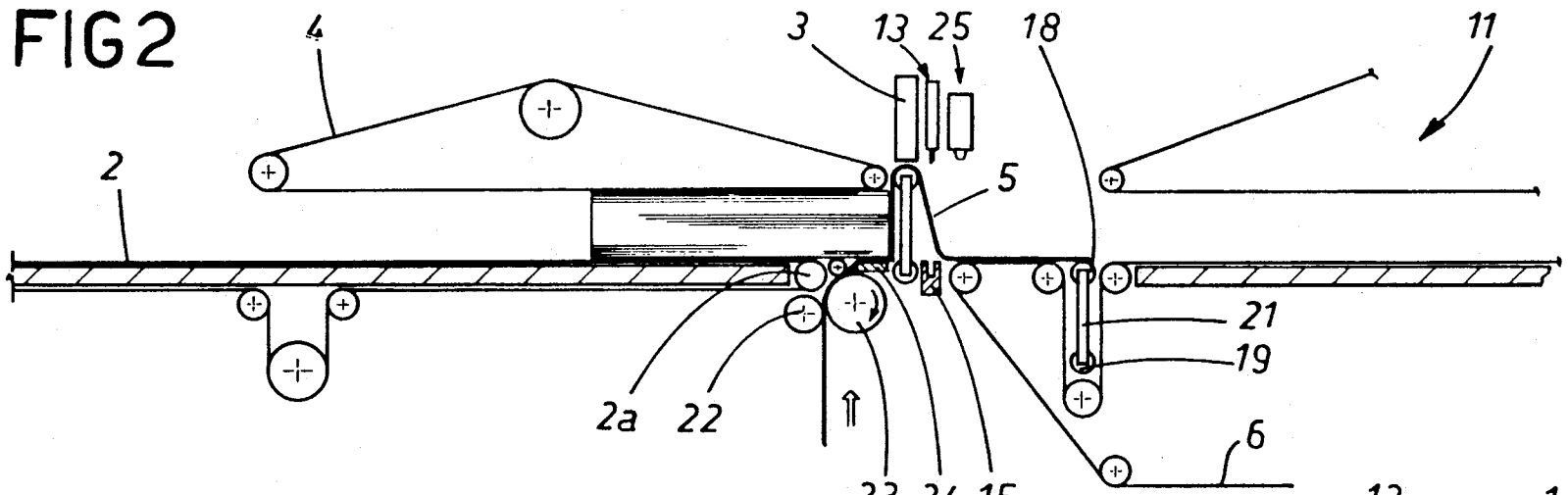
FIGS. 2, 3, 4 and 5 are views as in FIG. 1, each of which illustrating a successive step of the method disclosed.

The barrier 3 and the first wrapping gate 7 are now raised simultaneously, the effect of which is to draw the wrapping paper 5 upright into a vertical position and thus create an obstruction in the path of the advancing ream 1 (see FIG. 2); the opening afforded by the gate, it will be recalled, is equal in height to the height H of the ream 1.

Figure 3:
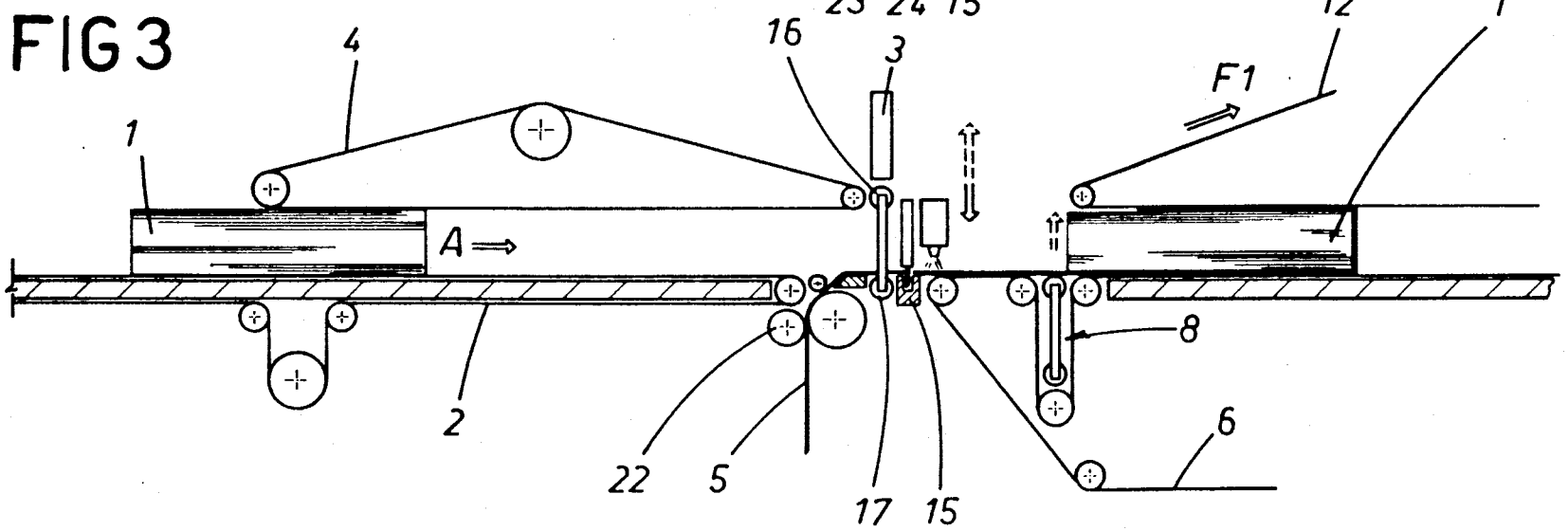

Thereupon, the ream 1 advances through the first gate 7 and the paper 5 is paid out simultaneously (or rather at the same rate of progress) from the feed station 10, intercepting and folding over the ream as it is drawn forward until the leading and bottom faces and part of the top face of the ream are enveloped by a first portion of the paper 5 (constrained thus by the rollers 16 and 17) and the ream itself passes onto the third belt (see FIG. 3). At the close of this first wrapping step, with the ream 1 fully beyond the feed station 10, forward motion is suspended and the blade 14 descends to cut through the wrapping paper 5 on a line adjacent to the first gate 7; the applicator means 25 also descend, and gum is sprayed on the trailing edge 5*a* left by the cut (also FIG. 3).

Figure 4:
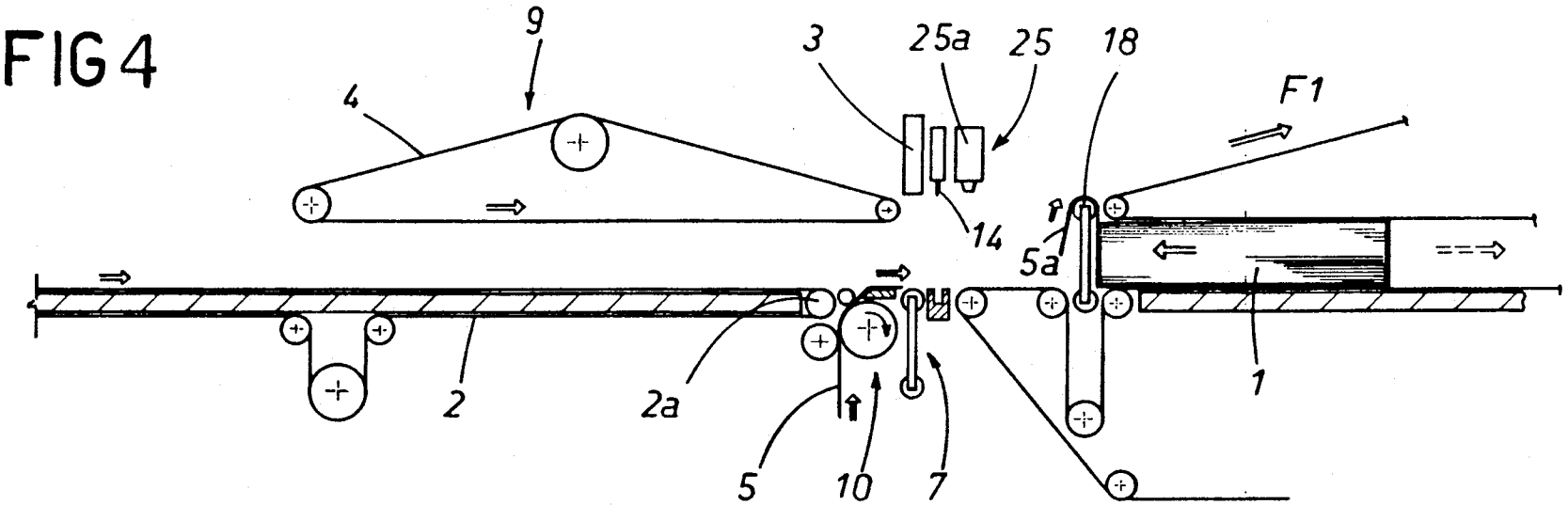

This accomplished, the second wrapping gate 8 is raised at the rear end of the third belt 6 in such a manner as to draw up the trailing portion of the paper 5, which has still to be wrapped around the ream (see FIG. 4).

Figure 5:
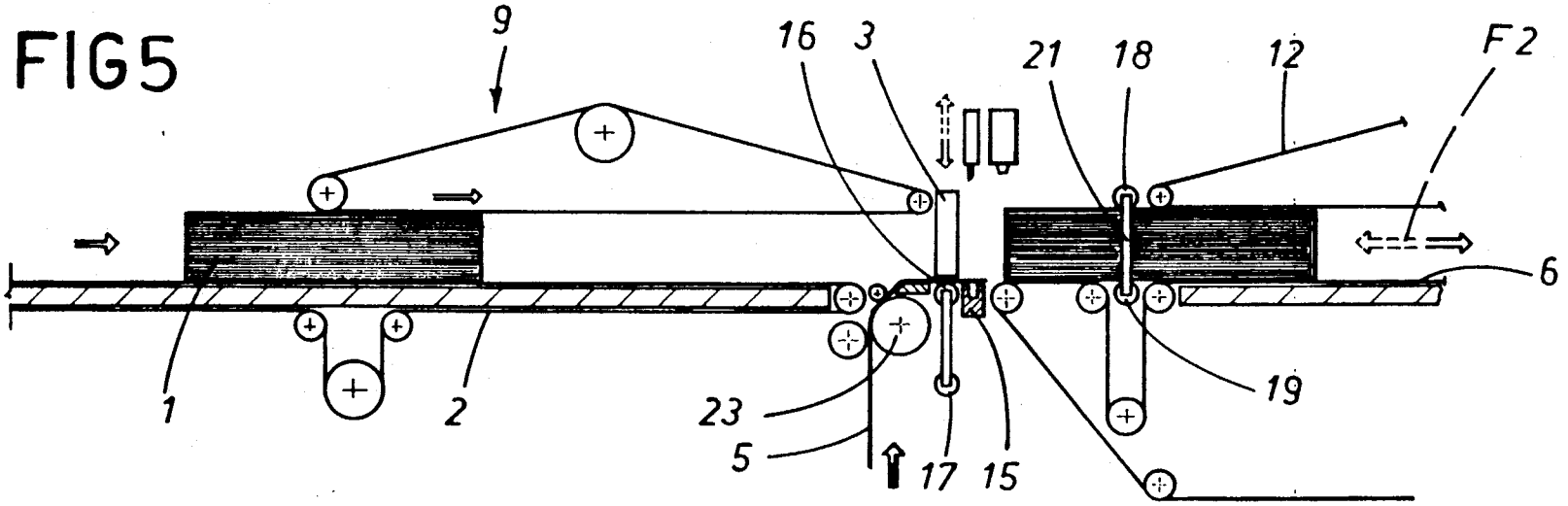

As the second gate 8 assumes the raised position, the third belt 6 is set in motion in the reverse direction, indicated by the arrow denoted F2, FIG. 5 (opposite to the general conveying direction A), in such a way that the ream 1 moves backward through the gate, impinging on the relative portion of the paper 5 and drawing it through the opening to the point at which four faces of the ream 1 are fully enveloped and the two cut edges of the wrapping paper 5 are overlapped and secured by the gum. There remains the further step of reactivating the third belt 6 in the original forward direction A to distance the wrapped ream 1 (the situation shown in FIG. 1, which coincides with the start of a further wrapping cycle).

Thus, adopting the method disclosed, and equipment for its implementation as described and illustrated herein, reams of paper can be packaged in perfectly tensioned wrappers with edges accurately gummed and joined, utilizing a more compact machine; moreover, the manner in which the equipment is constructed permits of adaptation to different ream sizes by a simple and swift adjustment of the passage height i.e. the respective distances between the conveying and the constraint elements (the belt loops and the rollers of the wrapping gates).

What is claimed:

1. A method of wrapping reams of paper, in particular large size reams, comprising the steps of:

aligning and compacting the sheets of a ream advancing in a horizontal conveying direction on a first power driven belt, by interaction with at least one transverse vertical barrier and by the descent of a movable second belt facing and running at the same surface speed as the first belt;

drawing out and extending a predetermined length of wrapping paper from below the level of the first belt through a feed station, positioned preceding the vertical barrier in relation to the conveying direction, and onto a third belt positioned beyond the vertical barrier in relation to the conveying direction;

raising the vertical barrier, and raising and interposing a first wrapping gate affording an opening of height equal at least to the height of the ream, in such a way as to draw the extended wrapping paper upright in the manner of a wall occupying the path of the advancing ream;

simultaneously advancing the ream through the opening of the gate in such a way as to impinge on the upright wrapping paper and supplying further paper from the feed station at the same rate as that of the advance, until a part of the ream including the leading face is enveloped by a first portion of the wrapping paper and the ream is carried at least onto the third belt and beyond the feed station;

bringing the ream to a standstill on the third belt, then cutting through the extended wrapping paper at a point adjacent to the first gate and simultaneously applying gum to the edge of the paper severed by the cut;

raising a second wrapping gate, positioned at the entry end of the third belt and identical to the first gate, in such a way as to draw upright the remaining portion of the wrapping paper not yet enveloping the ream;

reversing the conveying direction of the third belt in such a way that the ream is caused to pass backwards, through the second gate, impinging on the remaining portion of the wrapping paper and becoming completely enveloped with the cut edges of the paper overlapped and secured by the gum.

2. A method as in claim 1, comprising the additional step of activating the third belt in the original conveying direction to distance the enveloped ream from the second gate.

3. Equipment for wrapping reams of paper comprising:

a first station by which single reams are conveyed in a horizontal direction, consisting in at least one first belt;

a vertical barrier located immediately beyond the first belt in the conveying direction and capable of descending and ascending in such a way as to assist in compaction and subsequently to allow the passage of each successive ream;

a feed station adjacent to the vertical barrier, below the level of the first conveying station, by which a predetermined length of wrapping paper is drawn out and extended in the conveying direction;

a first wrapping gate capable of movement in the vertical direction, positioned proximate to and operated in concert with the vertical barrier, so as to elevate a portion of the extended wrapping paper, and affording an opening of which the height is matched to the height of the ream such that the ream can pass through while impinging frontally on the paper;

cutting means adjacent to the first wrapping gate and capable of motion in a direction substantially transverse to the conveying direction, by which the length of wrapping paper is severed to leave a trailing edge following the passage of the ream through and beyond the gate;

a second conveying station consisting in a third belt occupying the same plane as the first belt, and a fourth belt capable of movement in the direction opposite to the conveying direction, which is disposed parallel with and facing the third belt in such a way as to afford a passage to the advancing ream and favor its partial envelopment by a first portion of the wrapping paper;

a second wrapping gate similar in embodiment to the first, capable of movement in the vertical direction and positioned immediately preceding the second conveying station relative to the conveying direction, by which the portion of the wrapping paper not yet in contact with the ream is drawn upright and caused subsequently to envelop the ream when the ream is reversed through the gate in the direction opposite to the conveying direction.

4. Equipment as in claim 3 wherein the cutting means comprise a vertical blade and a relative striking plate positioned beneath the blade, and are flanked by applicator means disposed parallel to the blade and capable of movement in a direction essentially transverse to the conveying direction, of which the function is to deposit gum on the trailing edge of the wrapping paper cut by the blade.

5. Equipment as in claim 3 wherein the first and the second wrapping gates are embodied each as a pair of freely revolving horizontal and parallel rollers interconnected adjustably by a respective pair of vertical rods in such a way that the height of the passage afforded by the rollers can be matched to the height of the ream.

6. Equipment as in claim 3 wherein the first conveying station comprises a second belt positioned directly above and facing the first belt, such that the two belts run parallel and at the same surface speed, and capable of ascending and descending movement in such a way as to permit of compacting an advancing ream.

7. Equipment as in claim 3 wherein the feed station consists in a pair of rollers located immediately beyond the first belt, rotatable about horizontal axes and coupled to the driving roller of the belt in such a manner that the wrapping paper is drawn up from beneath and directed forward at a rate of feed identical to the velocity at which the ream is directed over a horizontal platform positioned between the driving roller and the barrier.

* * * * *